US006059616A

United States Patent [19]

Bluemmel et al.

[11] Patent Number: 6,059,616

[45] Date of Patent: May 9, 2000

[54] CRIMP CONTACT FOR PLUG-IN SYSTEMS

[75] Inventors: Uwe Bluemmel, Speyer; Hans-Jost Heimueller, Dudenhofen, both of Germany

[73] Assignee: Siemens Aktiengesellschaft, Munich, Germany

[21] Appl. No.: 09/174,330

[22] Filed: Oct. 19, 1998

[30] Foreign Application Priority Data

Dec. 9, 1997 [DE] Germany ..... 297 21 752 U

[51] Int. Cl.[7] ..... H01R 4/18

[52] U.S. Cl. ..... 439/867; 439/877

[58] Field of Search ..... 439/865, 866, 439/867, 880, 881, 877, 421, 423, 851, 852

[56] References Cited

U.S. PATENT DOCUMENTS 4,863,391 9/1989 Mochizuki ..... 439/867

5,162,004 11/1992 Kuzuno et al. ..... 439/867

5,795,197 8/1998 Tsuji et al. ..... 439/877

*Primary Examiner*—Michael L. Gellner

*Assistant Examiner*—Antoine Ngandjui

*Attorney, Agent, or Firm*—Hill & Simpson

[57] ABSTRACT

A crimp contact is provided for connecting an electrical line to a rectangularly profiled contact member of a plug-in system. The crimp contact includes a contact piece connected to a transitional region. The transitional region is connected to a wire crimp and disposed between the contact piece and the wire crimp. The wire crimp is connected to an insulating crimp and is disposed between the transitional region and the insulating crimp. The insulating crimp includes a planar base side disposed between two opposing legs. The planar base side and opposing legs have a substantially rectangular profile after the crimp contact is connected to the electrical line.

19 Claims, 4 Drawing Sheets

CRIMP CONTACT FOR PLUG-IN SYSTEMS

FIELD OF THE INVENTION

The invention relates generally to a crimp contact for plug-in systems with angular contact chambers which can be attached to stripped ends of electrical lines and which has a contact piece, a transitional region, a wire crimp and an insulating crimp.

BACKGROUND OF THE INVENTION

Plug-in systems with a plurality of contact chambers often require that the contacts contained therein to be of a small overall size because the diameters of lines to be connected are often barely smaller than the spacing of the individual contact chambers. In particular, when crimp contacts are used, problems of space may occur specifically in the region of the insulating crimp. When loading a plug housing, it is also important that the contacts can be introduced into the contact chambers with little force, without the contacts being bent in the process, because deformation causes additional problems with respect to space. This problem has previously been solved by limiting the admissible wire sizes for round or B-shaped insulating crimps.

SUMMARY OF THE INVENTION

The present invention is based on the object of providing a crimp contact with which the disadvantages and problems mentioned above do not occur.

According to the present invention, a crimp contact is provided for plug-in systems with angular contact chambers which can be attached to stripped ends of electrical lines and which has a contact piece, a transitional region adjoining the latter, a wire crimp and an insulating crimp at the end on the line side. The insulating crimp has a planar base side with two legs adjoining the latter and exhibits a substantially rectangular profile after it is attached to a line.

With a crimp contact according to the invention, the space available in plug-in systems with angular contact chambers is used more efficiently. The unproblematical loading of the individual contact chambers with crimp contacts is ensured. Since it tends to be more difficult to configure angular insulating crimps during crimp working than in the case of previously customary forms, supporting measures at the contact are advantageously required.

In an advantageous development, the legs of the insulating crimp have predetermined bending points at their free ends. There are several alternative ways of accomplishing these predetermined bending points. In one embodiment, the legs of the insulating crimp may in each case have an impression on their inner side in the region of the predetermined bending points. The impressions make it possible for the free ends of the insulating crimp legs to be bent over at right angles. Alternatively, the legs of the insulating crimp may be provided with lateral slits or, in each case, a central slit in the region of the predetermined bending points. A further possible way of accomplishing defined predetermined bending points at the free ends of the insulating crimp legs is for the end portions of the insulating crimp legs to be narrowed from the predetermined bending points. Supporting measures which make it possible for the insulating crimp legs to be bent over at right angles are not required at the transition between the base side of the insulating crimp and the crimp legs because smaller bending changes are required there during working to achieve right-angled bends. Such deformations of the legs can already be achieved with a suitable fabricating tool.

In an advantageous development, the legs of the insulating crimp have in each case at least one clearance. Similarly, the insulating crimp may be provided with at least one clearance on its base side. The advantage of these clearances is that they create further storage space for the insulation of an electrical line connected to the crimp contact.

In a further development, the leg portions are of different heights perpendicularly with respect to the base side of the insulating crimp in a state in which the crimp is attached to a line. This is achieved by different lengths of the insulating crimp legs, by different positions of the predetermined bending points on the insulating crimp legs and also by corresponding formations on the fabricating tool. The advantage of such an asymmetrical design of the crimp legs is that the cross-section of the insulating crimp can be adapted to the contour of an asymmetrically hollowed-out contact chamber, in order to make optimum use of the available space. Asymmetrical contact chambers are appropriate, for example, for the identification of contacts with different polarities. Furthermore, the legs of the insulating crimp may also overlap at their free ends in a state in which it is attached to a line.

In an embodiment, the present invention provides a crimp contact for connecting an electrical line to a rectangularly profiled contact member of a plug-in system. The crimp contact of the present invention comprises a contact piece connected to a transitional region. The transitional region being connected to a wire crimp. The transitional region being disposed between the contact piece and the wire crimp. The wire crimp also being connected to an insulating crimp with the wire crimp being disposed between the transitional region and the insulating crimp. The insulating crimp comprising a planar base side disposed between two opposing crimp legs. The planar base side and crimp legs having a substantially rectangular profile after the crimp contact is connected to the electrical line.

In an embodiment, the opposing crimp leg of the insulating crimp comprise a main section connected to a free end with a predetermined bending point disposed therebetween.

In an embodiment, each predetermined bending point of each opposing crimp leg comprises a lateral impression for facilitating the bending of each leg between the main section and the free end thereof.

In an embodiment, the predetermined bending points each comprise a lateral split.

In an embodiment, the predetermined bending points comprise a centrally located lateral slit.

In an embodiment, the free ends of each opposing crimp leg is narrower than the corresponding main portion thereof.

In an embodiment, each leg of the insulating crimp comprises an aperture for accommodating insulating material.

In an embodiment, the base side of the insulating crimp comprises an aperture for accommodating insulating material.

In an embodiment, the two opposing crimp legs of the insulating crimp each have a height. The height of one leg being greater than the height of the other leg.

In an embodiment, the free ends of the opposing crimp legs of the insulating crimp overlap after the crimp is attached to the electrical line.

In an embodiment, the free ends of the opposing crimp legs of the insulating crimp buttingly engage each other after the crimp is attached to the electrical line.

Other objects and advantages of the invention will become apparent upon reading the following detailed description and appended claims, and upon reference to the accompanying drawings.

BRIEF DESCRIPTION OF THE DRAWING

The invention is explained in more detail below on the basis of exemplary embodiments with reference to the drawing, in which.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
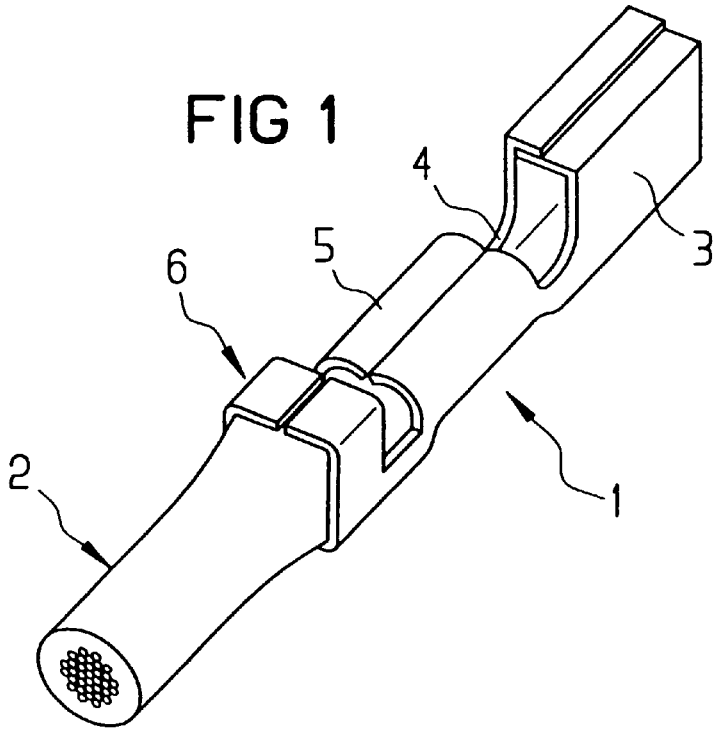
FIG. 1 is a perspective view of a crimp contact according to the present invention in a state in which it is attached to a line.

FIG. 1 shows a finished crimp contact 1 according to the invention, which has been attached to a stripped end of an electrical line 2. The crimp contact 1 comprises a contact piece 3, a transitional region 4 adjoining the latter, a wire crimp 5 and an insulating crimp 6. By contrast with the B-shaped wire crimp 5, the insulating crimp 6 exhibits a rectangular profile, in adaptation to the shape of contact chambers of a plug system.

Figure 2:
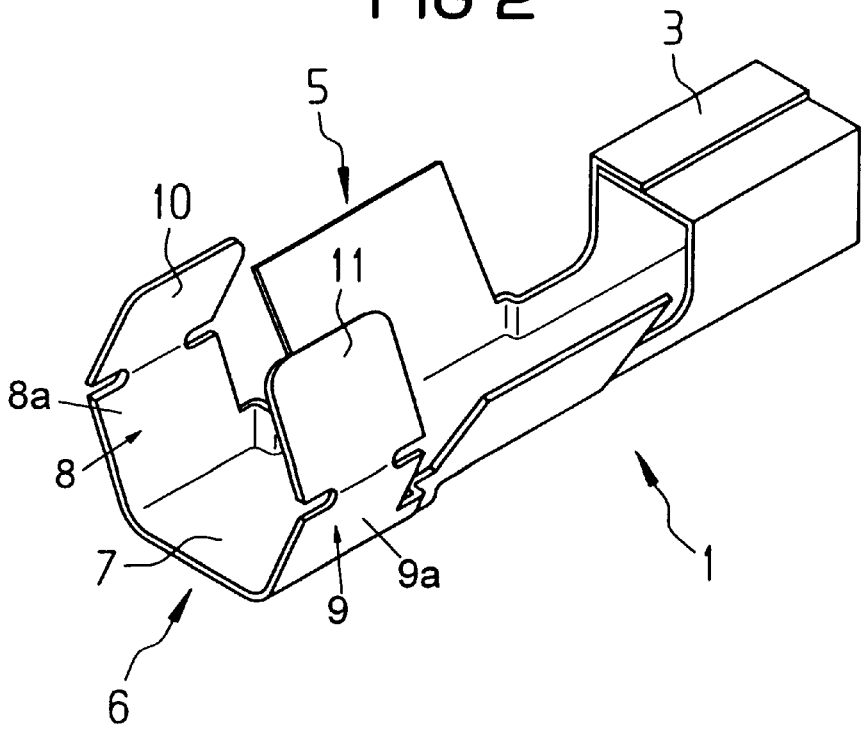
FIG. 2 is a perspective view of a still unworked crimp contact according to the present invention.

FIG. 2 shows a crimp contact according to FIG. 1, but in the unworked state. The wire crimp 5 has a parabolic cross-section, while the insulating crimp 6 is divided into a planar base side 7 and two insulating crimp legs 8 and 9 adjoining the latter. A planar base side 7 must have already been ensured before the crimp working, since with a corresponding fabricating tool such a formation can be produced only with difficulty. During the working of the crimp contact, only a small change in bending angle is required in the transitional region between the base side 7 and the crimp legs 8 and 9, while a distinct change in bending angle is necessary at the transitional region between the free ends 10 and 11 of the legs and the main sections 8*a* and 9*a* of the crimp legs 8 and 9.

Figure 3A:
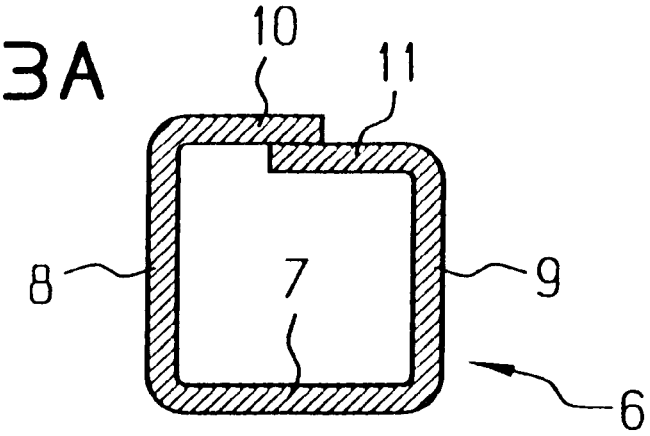
FIGS. 3*a* to 3*c* are end sectional views of three embodiments of an insulating crimp made in accordance with the present invention.
Figure 3B:
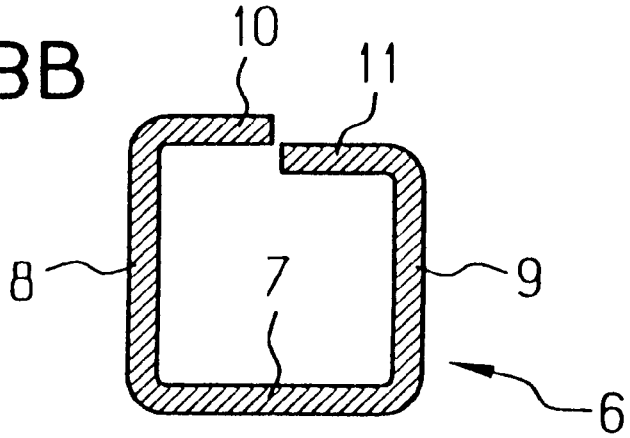
Figure 3C:
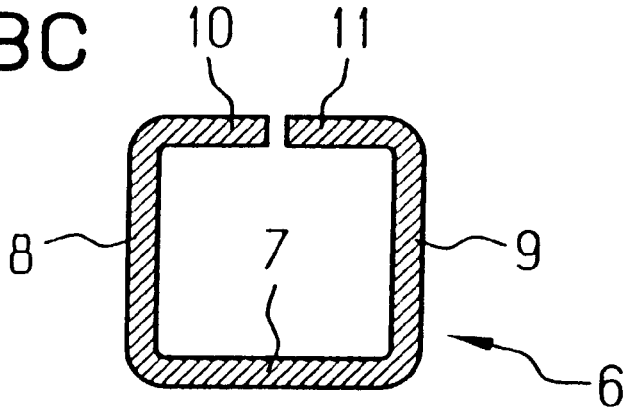

FIGS. 3*a* to 3*c* show several forms of design of an already worked insulating crimp in cross-section, the electrical line not being explicitly represented. By positioning predetermined bending points at different heights on the two insulating crimp legs 8 and 9 and by a corresponding design of the fabricating tool, the portions of the crimp legs 8 and 9 oriented at right angles with respect to the base surface 7 have different heights. In addition, the free ends 10 and 11 or the insulating crimp legs 8 and 9 overlap (FIG. 3*a*). This has the advantage that the insulating crimp legs 8 and 9 can be supported on each other at their free ends 10 and 11 during the working operation, in order to achieve an optimum right-angled configuration. With suitable measures for accomplishing the predetermined bending points between the end portions 10 and 11 and the crimp legs 8 and 9, it is also possible for the end portions 10 and 11 of the crimp legs merely to be adjacent to each other (FIG. 3*b*). As can be seen from FIG. 3*c*, a symmetrical configuration of the insulating crimp legs 8 and 9 as well as their end portions 10 and 11 is also possible.

Figure 4A:
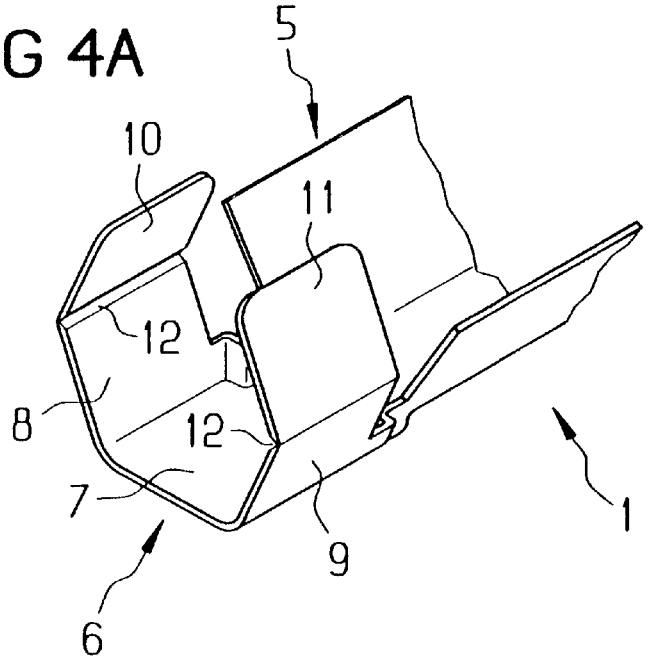
FIG. 4*a* is a partial perspective view of an insulating crimp of the present invention, particularly illustrating free ends of the legs with predetermined bending points.
Figure 4B:
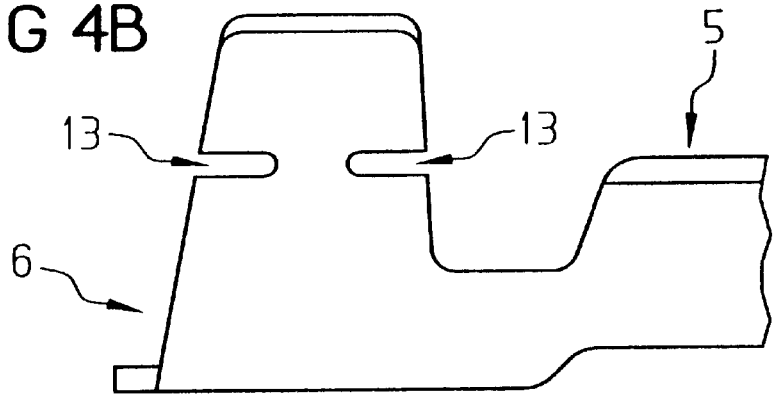
FIGS. 4*b* to 4*d* are partial side plan views of three embodiments that accomplish to defined predetermined bending points at free ends of insulating crimp legs in accordance with the present invention.
Figure 4C:
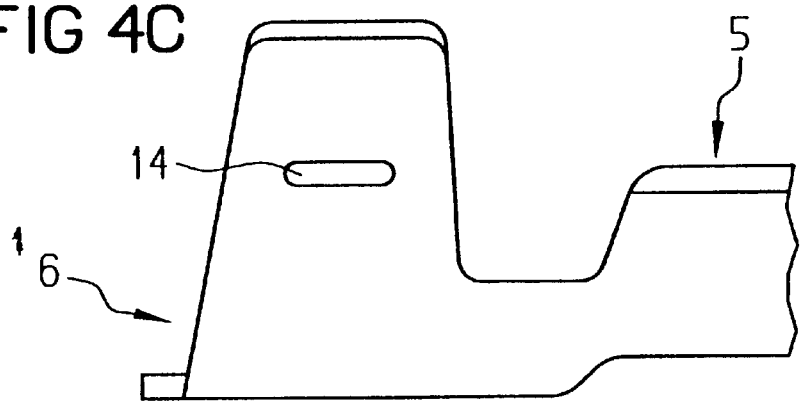
Figure 4D:
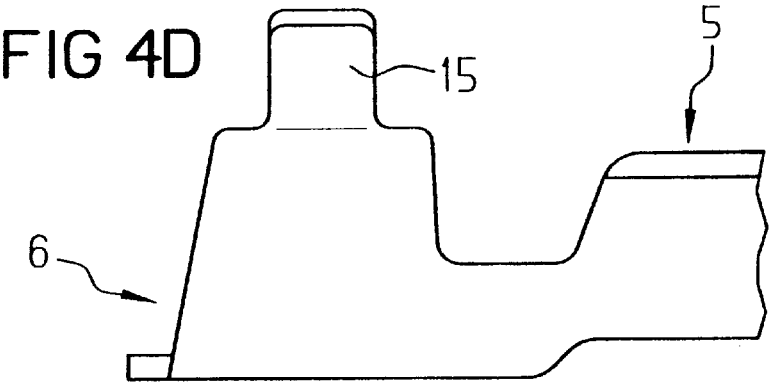

FIGS. 4*a* to 4*d* show suitable measures for accomplishing defined predetermined bending points in the transitional region between the insulating crimp legs 8 and 9 and the end portions 10 and 11. FIG. 4*a* shows a form of design with impressions 12 applied on the inner side of the crimp legs 8 and 9 in the region of the predetermined bending points and extending in a longitudinal direction of the crimp contact. Alternatively, the legs of the insulating crimp 6 may be provided with lateral slits 13, which make it easier for the end portions of the crimp legs to be bent over (FIG. 4*b*). Represented in FIG. 4*c* is a variant of the configuration with a central slit 14, which extends in the longitudinal direction of the crimp contact and likewise has the effect of accomplishing a predetermined bending point between the free ends and the leg portions oriented at right angles with respect to the base side of the insulating crimp 6. A further possibility is for the insulating crimp 6 to be formed with narrowed end portions 15 from the predetermined bending point on the crimp legs (FIG. 4*d*).

Figure 5A:
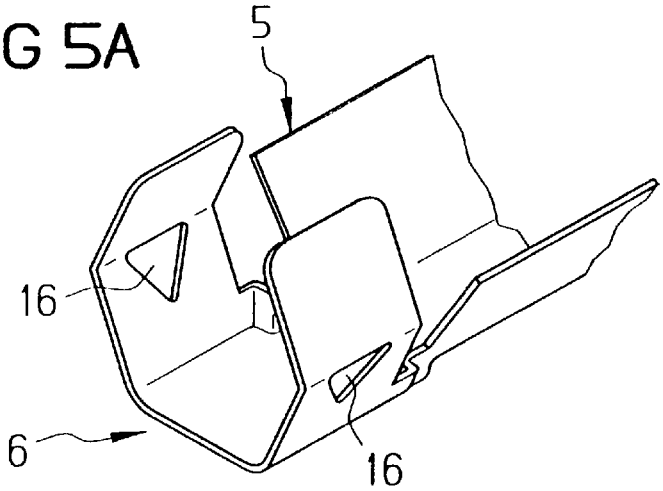
FIGS. 5*a* to 5*b* are partial perspective views that illustrate measures for creating storage space for the insulation of an electrical line.
Figure 5B:
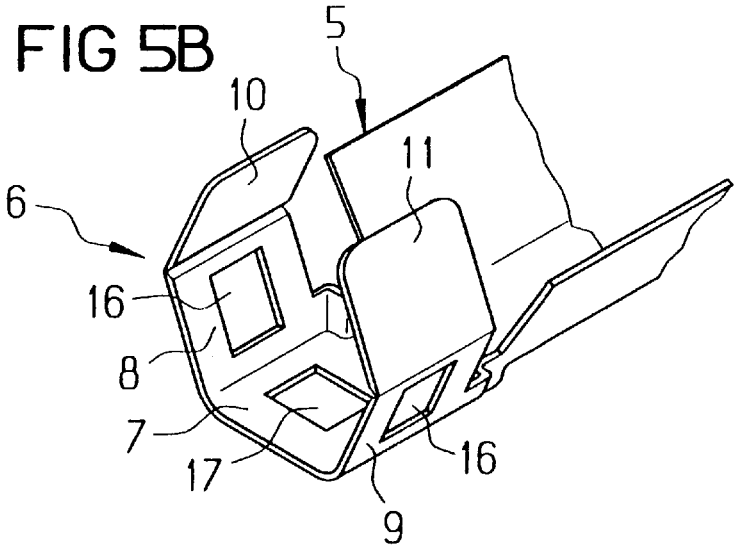

In order to create space for the insulating 25 material when attaching the insulating crimp to a stripped end of an electrical line, the crimp legs 8 aid 9 of the insulating crimp 6 are provided with clearances 16, into which insulating material of the conductor can be pressed (FIG. 5*a*). The upper end of the clearance 16 at the same time provides the predetermined bending point for the free end of the insulating crimp leg. In the embodiment represented in FIG. 5*b*, the base side 7 of the insulating crimp 6 also has a clearance 17, it being possible for the size and the geometry of the clearances 16 on the crimp legs 8 and 9 and of the clearance 17 on the base side 7 of the insulating crimp 6 to be adapted to the respective dimensions of the electrical conductor. However, in this case the predetermined bending points and the clearances 16 on the insulating crimp legs are designed independently of one another.

From the above description it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A crimp contact for connecting an electrical line to a rectangularly profiled contact member of a plug-in system, the crimp contact comprising:

a contact piece connected to a transitional region, the transitional region also connected to a wire crimp, the transitional region being disposed between the contact piece and the wire crimp, the wire crimp also connected to an insulating crimp, the wire crimp being disposed between the transitional region and the insulating crimp, the insulating crimp comprising a planar base side disposed between two opposing legs, the opposing legs each comprising a main section connected to a free end with a predetermined bending point disposed therebetween, the planar base side and the main sections and free ends of the opposing legs having a rectangular profile after the crimp contact is connected to the electrical line.

2. The crimp contact of claim 1 wherein each predetermined bending point comprises a lateral impression for facilitating the bending of each leg between the main section and the free end thereof.

3. The crimp contact of claim 1 wherein the predetermined bending points each comprise a lateral slit for facilitating the bending of each leg between the main section and the free end thereof.

4. The crimp contact of claim 1 wherein each predetermined bending point comprises a centrally located lateral slit for facilitating the bending of each leg between the main section and the free end thereof.

5. The crimp contact of claim 1 wherein the free ends of each opposing leg is narrower than the corresponding main portion thereof.

6. The crimp contact of claim 1 wherein each opposing leg of the insulating crimp comprises an aperture for accommodating insulating material.

7. The crimp contact of claim 1 wherein the base side of the insulating crimp an aperture for accommodating insulating material.

8. The crimp contact of claim 1 wherein the two opposing legs each have a height, the height of one leg being greater than the height of the other leg.

9. The crimp contact of claim 1 wherein the free ends of the opposing crimp legs of the insulating crimp overlap after the crimp is attached to the electrical line.

10. The crimp contact of claim 1 wherein the free ends of the opposing legs of the insulating crimp abuttingly engage each other after the crimp is attached to the electrical line.

11. A crimp contact for connecting an electrical line to a rectangularly profiled contact member of a plug-in system, the crimp contact comprising:

a contact piece connected to a transitional region, the transitional region also connected to a wire crimp, the transitional region being disposed between the contact piece and the wire crimp, the wire crimp also connected to an insulating crimp, the wire crimp being disposed between the transitional region and the insulating crimp, the insulating crimp comprises a planar base section disposed between two opposing legs, each opposing leg comprising a predetermined bending point disposed between a main section and a free end, the planar base section, the main sections of the two opposing legs and the free ends of the two opposing legs having a substantially rectangular profile as they surround the electrical line.

12. The crimp contact of claim 11 wherein each predetermined bending point comprises a lateral impression for facilitating the bending of each leg between the main section and the free end thereof.

13. The crimp contact of claim 11 wherein the predetermined bending points each comprise a lateral slit for facilitating the bending of each leg between the main section and the free end thereof.

14. The crimp contact of claim 11 wherein each predetermined bending point comprises a centrally located lateral slit for facilitating the bending of each leg between the main section and the free end thereof.

15. The crimp contact of claim 11 wherein the free ends of each opposing leg is narrower than the corresponding main portion thereof.

16. The crimp contact of claim 11 wherein each opposing leg of the insulating crimp comprises an aperture for accommodating insulating material.

17. The crimp contact of claim 11 wherein the base side of the insulating crimp an aperture for accommodating insulating material.

18. The crimp contact of claim 11 wherein the two opposing legs each have a height, the height of one leg being greater than the height of the other leg.

19. The crimp contact of claim 11 wherein the free ends of the opposing crimp legs of the insulating crimp overlap after the crimp is attached to the electrical line.

* * * * *